US009326904B2

(12) United States Patent
Nomura et al.

(10) Patent No.: US 9,326,904 B2
(45) Date of Patent: May 3, 2016

(54) AIR MATTRESS WITH INTERNAL PUMP

(75) Inventors: Katsuyoshi Nomura, Tokyo (JP); Shinji Ueki, Tokyo (JP); Makoto Tanaka, Tokyo (JP); Takayuki Masukawa, Tokyo (JP)

(73) Assignee: PARAMOUNT BED CO., LTD., Tokyo (JP)

( * ) Notice: Subject to any disclaimer, the term of this patent is extended or adjusted under 35 U.S.C. 154(b) by 791 days.

(21) Appl. No.: 13/519,564

(22) PCT Filed: Oct. 19, 2010

(86) PCT No.: PCT/JP2010/068300

§ 371 (c)(1),
(2), (4) Date: Aug. 15, 2012

(87) PCT Pub. No.: WO2011/096112

PCT Pub. Date: Aug. 11, 2011

(65) Prior Publication Data

US 2012/0311790 A1 Dec. 13, 2012

(30) Foreign Application Priority Data

Feb. 5, 2010 (JP) ..... 2010-024861

(51) Int. Cl.
*A61G 7/057* (2006.01)
*A47C 27/08* (2006.01)
*A47C 27/10* (2006.01)

(52) U.S. Cl.
CPC ..... *A61G 7/05776* (2013.01); *A47C 27/082* (2013.01); *A47C 27/10* (2013.01); *A61G 2203/34* (2013.01)

(58) Field of Classification Search
CPC .. A47C 27/083; A47C 27/082; A47C 27/081; A47C 27/08; A47C 27/10; A61G 7/05769; A61G 7/05776
USPC ..... 5/710, 713, 706, 714, 655.3, 654, 644, 5/708
See application file for complete search history.

(56) References Cited

U.S. PATENT DOCUMENTS 3,583,008 A * 6/1971 Edwards ..... 5/655.3
5,018,226 A * 5/1991 Davies et al. ..... 5/81.1 R (Continued)

FOREIGN PATENT DOCUMENTS

JP 9-224983 A 9/1997
JP 2000-126257 A 5/2000

(Continued)

OTHER PUBLICATIONS

Korean Office Action dated Nov. 26, 2013, with Japanese and partial English translation.

(Continued)

*Primary Examiner* — Robert G Santos
(74) *Attorney, Agent, or Firm* — McGinn IP Law Group PLLC

(57) ABSTRACT

An air mattress with an internal pump has a plurality of air cell groups lined up in the lengthwise direction of the air mattress. Each of air cell groups has a plurality of bladder-shaped cells lined up in the lengthwise direction of the air mattress. The air mattress has an air supply/release pump; and an air tube linking the air cell groups and the air supply/release pump in an independent system for each air cell group out of two or more air cell groups. All of the bladder-shaped cells are rod shapes extending in the widthwise direction of the air mattress, and the length of the air cell groups corresponding to the leg area of a reclining person is up to 30% less than that of the other bladder-shaped cells, leaving a space between there and the edge of the air mattress in which the air supply/release pump is disposed.

16 Claims, 6 Drawing Sheets

(56) References Cited

U.S. PATENT DOCUMENTS

| | | | | | |
|---|---|---|---|---|---|
| 5,325,551 | A * | 7/1994 | Tappel et al. | | 5/709 |
| 5,542,136 | A * | 8/1996 | Tappel | | 5/710 |
| 5,659,908 | A * | 8/1997 | Nishino | | 5/676 |
| 5,794,289 | A * | 8/1998 | Wortman et al. | | 5/713 |
| 5,848,450 | A * | 12/1998 | Oexman et al. | | 5/713 |
| 5,926,883 | A * | 7/1999 | Rechin et al. | | 5/706 |
| 6,061,855 | A * | 5/2000 | Flick | | 5/713 |
| 6,145,142 | A * | 11/2000 | Rechin et al. | | 5/706 |
| 6,151,735 | A * | 11/2000 | Koby et al. | | 5/644 |
| 6,611,981 | B1 * | 9/2003 | Lin | | 5/708 |
| 8,127,386 | B2 * | 3/2012 | Kajiwara | A61G 7/05776 | 5/710 |
| 8,745,784 | B2 * | 6/2014 | Cole et al. | | 5/423 |
| 9,095,224 | B2 * | 8/2015 | Tanaka | A47C 27/082 | |
| 9,114,048 | B2 * | 8/2015 | Takeda | A61G 7/05776 | |
| 2010/0263131 | A1 * | 10/2010 | Kajiwara | A61G 7/05776 | 5/710 |
| 2011/0035880 | A1 * | 2/2011 | Cole et al. | | 5/423 |
| 2012/0291204 | A1 * | 11/2012 | Takeda et al. | | 5/710 |
| 2012/0304385 | A1 * | 12/2012 | Ishibashi | A47C 27/083 | 5/613 |
| 2012/0311790 | A1 * | 12/2012 | Nomura et al. | | 5/710 |
| 2012/0317727 | A1 * | 12/2012 | Tanaka et al. | | 5/710 |
| 2015/0000044 | A1 * | 1/2015 | Morimura | A47C 27/083 | 5/710 |

FOREIGN PATENT DOCUMENTS

| | | | |
|---|---|---|---|
| JP | 2000-189288 | A | 7/2000 |
| JP | 2004-222743 | A | 8/2004 |
| JP | 2006-297056 | A | 11/2006 |

OTHER PUBLICATIONS

International Search Report in PCT/JP2010/068300 dated Dec. 7, 2010 (English Translation Thereof).

* cited by examiner

AIR MATTRESS WITH INTERNAL PUMP

TECHNICAL FIELD

The present invention relates to an air mattress with an internal pump for medical or caretaking use, and in particular to an air mattress with an internal pump in which ease of performing caretaking work and ease of maintenance are improved.

BACKGROUND ART

Air mattresses or air-type bedding such as that disclosed in Patent Documents 1 through 3 is known in the art. Patent Document 1 discloses a technique in which air bladders corresponding to the thigh area, right and left shoulder area, or buttock area of a person reclining upon a base mat of an air mattress are provided, the supply and release of air to and from these air bladders is controlled by a control device, and the breathing motions of the person lying on the air mattress are assisted. In the air mattress disclosed in Patent Document 1, the air supply/release device for inflating and deflating the air bladders is disposed at a corner of the base mat, or disposed upon the exterior of the base mat.

Patent Document 2 discloses an air-type bedding having a configuration in which a plurality of air bladders is provided upon an upper surface of a spread bedding such as a mattress or the like at positions corresponding to the thigh area, feet area, and other lower extremities of a person reclining on the mattress, and rubbing of the lower extremities of the person lying on the mattress is performed through the inflation and deflation of these air bladders.

Patent Document 3 discloses an air mattress for preventing decubitus ulcers in which a reinforcing member is provided at an end of the air mattress in the lengthwise direction, i.e., an end on the head area side or leg area side of a person lying on the air mattress, a soft member formed from an elastic material softer than that of the reinforcing member is provided further toward the exterior than the reinforcing member, and an air supply pump is embedded within the soft member. Patent Document 3 also discloses that the air supply pump can be prevented from impeding the work of a caretaker or the like by integrating the pump with the mattress.

PRIOR ART LITERATURE

Patent Literature

Patent Document 1: Japanese Laid-open Patent Application No 2006-297056

Patent Document 2: Japanese Laid-open Patent Application No 2004-222743

Patent Document 3: Japanese Laid-open Patent Application No 2000-189288

DISCLOSURE OF THE INVENTION

Problems the Invention is Intended to Solve

The prior art described above presents problems such as those described below. In the air mattress according to Patent Document 1, when the air supply/release device is provided on the exterior of the base mat, the air supply/release device must be moved separately from the mattress when the mattress is being moved, reducing the ease of performing medical or caretaking work. In such cases, there is also the problem that the air supply/release device and air tube end up being disposed to the exterior of the mattress, increasing the risk of the air supply/release device and air tube breaking.

The mattress according to Patent Document 2 is one in which the air bladders are provided upon the base mat, which is formed from an elastic material, and is not used as an air mattress. As such, the mattress does not allow body pressure to be dispersed by adjusting the air pressure at positions along the lengthwise direction of the mattress.

In the air mattress according to Patent Document 3, there is a need to provide a reinforcing member and flexible member at an end of the air mattress with respect to the lengthwise direction in order to provide the air supply pump, and not only is the structure of the air mattress complicated, but the size of the air mattress is also increased more than is necessary. As such, there is the problem that limited caretaking space cannot be sufficiently utilized in the case of, for example, home caretaking or the like. There is also the problem that the ease of maintenance of the pump and air tube is low due to the structure in which the pump and air tube are embedded within the interior of the air mattress, and the entirety of the air mattress is further covered by exterior material.

An object of the present invention is to provide an air mattress with an internal pump wherein an air supply/release pump can be contained within the space occupied by a conventional air mattress, and the ease of handling of the pump, ease of performing caretaking work, and ease of maintenance are improved without reducing comfort.

Means for Solving the Problems

The air mattress with an internal pump according to the present invention has a plurality of air cell groups lined up in the lengthwise direction of the air mattress, each of which groups made from a plurality of bladder-shaped cells, an air supply/release pump, and an air tube linking the air cell groups and the air supply/release pump in an independent system for each air cell group of two or more air cell groups out of the air cell groups. All of the bladder-shaped cells of the air cell groups are rod-shaped cells extending in a widthwise direction of the air mattress; each of the air cell groups is configured so that the bladder-shaped cells are lined up in the lengthwise direction of the air mattress. The bladder-shaped cells of the air cell groups other than the air cell groups corresponding to the heel area of a person lying on the air mattress extend to an edge of the air mattress. The length of the bladder-shaped cells of the air cell groups corresponding to the heel area is up to 30% less than that of the other bladder-shaped cells, a space is left between the cells and the edge of the air mattress. The air supply/release pump is disposed in the space. In the present invention, the length of the bladder-shaped cells of the air cell groups corresponding to the heel area is, for example, less than that of the other bladder-shaped cells by at least the width of the air supply/release pump while falling within the range described above.

In the air mattress with an internal pump described above, for example, the pressure within the bladder-shaped cells can be controlled individually for each of the air cell groups among the air cell groups linked in independent systems by said air tubes.

In the air mattress with an internal pump, it is possible to remove said air supply/release pump by, for example, detaching said air tube from said air supply/release pump.

It is preferable that the exterior surface of said air supply/release pump be covered by a flexible member. The air mattress with an internal pump also has, for example, a top cover covering the upper surfaces of said plurality of air cell groups and said air supply/release pump.

Effects of the Invention

In the air mattress with an internal pump according to the present invention, the plurality of bladder-shaped cells are rod-shaped cells extending in the widthwise direction of the air mattress and being configured so as to be lined up in the lengthwise direction of the air mattress, and support the body of a person lying on the air mattress. The length of the bladder-shaped cells of the air cell groups corresponding to the heel area of the person lying on the air mattress is up to 30% less than that of the other bladder-shaped cells, leaving a space between the cells and the edge of the mattress, in which space is disposed the air supply/release pump. The part corresponding to the side of the heel area is a part that the body of the user of the air mattress does not readily contact even if the user turns over while sleeping, so that comfort is not reduced. The air supply/release pump fits into the space occupied by a conventional air mattress, and does not need to be provided on the exterior of the air mattress, thereby allowing for easy handling thereof.

Because the air supply/release pump is internal to the air mattress, ease of performing caretaking work when using the air mattress of the present invention is high; and because the air supply/release pump is disposed at a corner of the air mattress, a caretaker or the like can easily contact and perform maintenance upon the air supply/release pump and air tube.

BEST MODE FOR CARRYING OUT THE INVENTION

Figure 1:
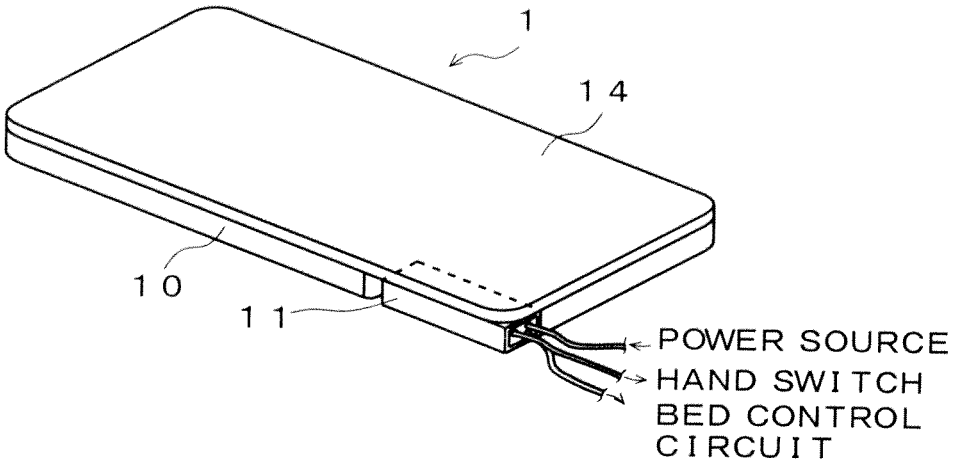
FIG. 1 is a perspective view of an air mattress with an internal pump according to an embodiment of the present invention.
Figure 2:
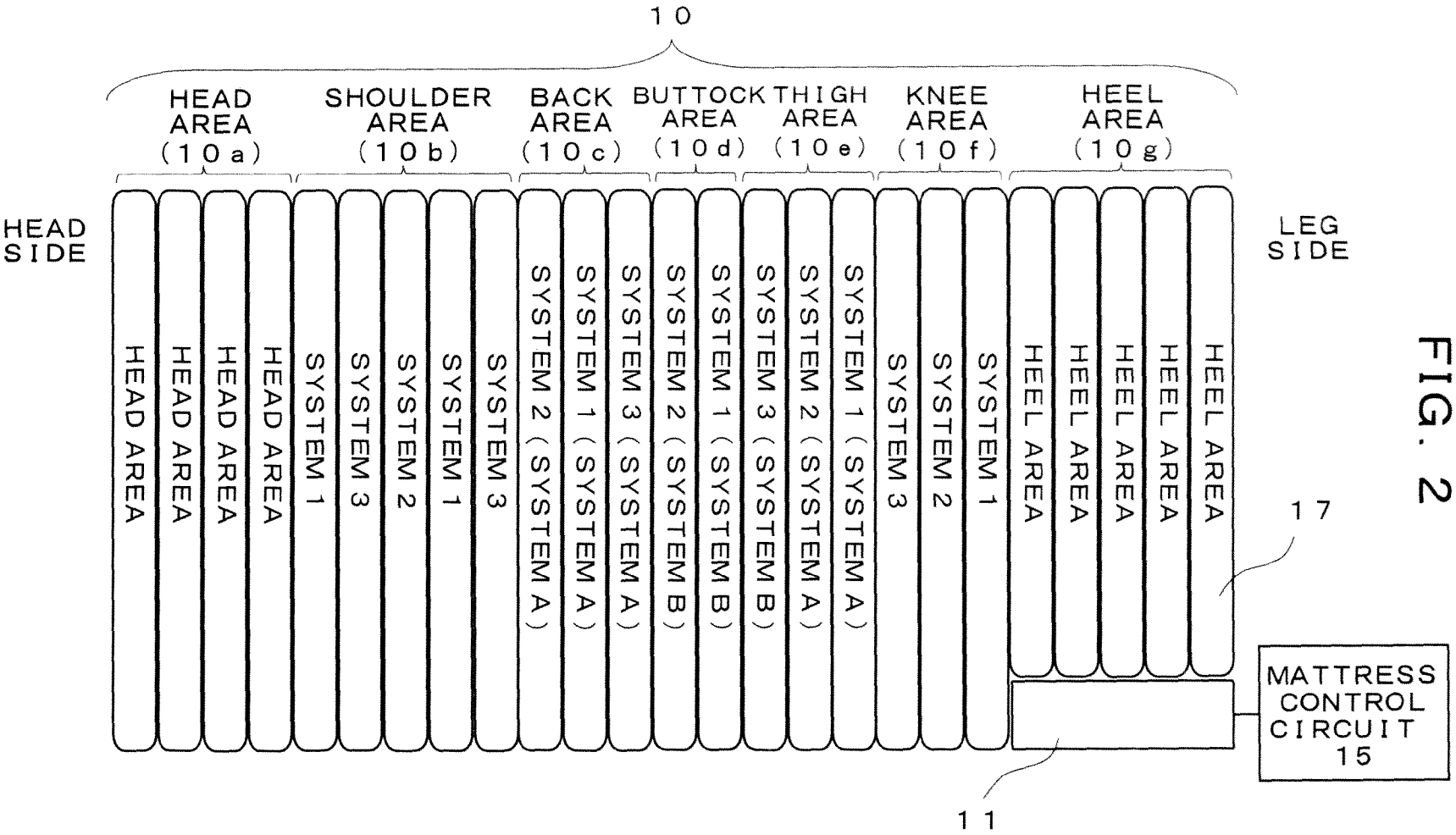
FIG. 2 is a plan view of the disposition of each of the bladder-shaped cells and the air supply/release pump of an air mattress with an internal pump according to an embodiment of the present invention.
Figure 3:
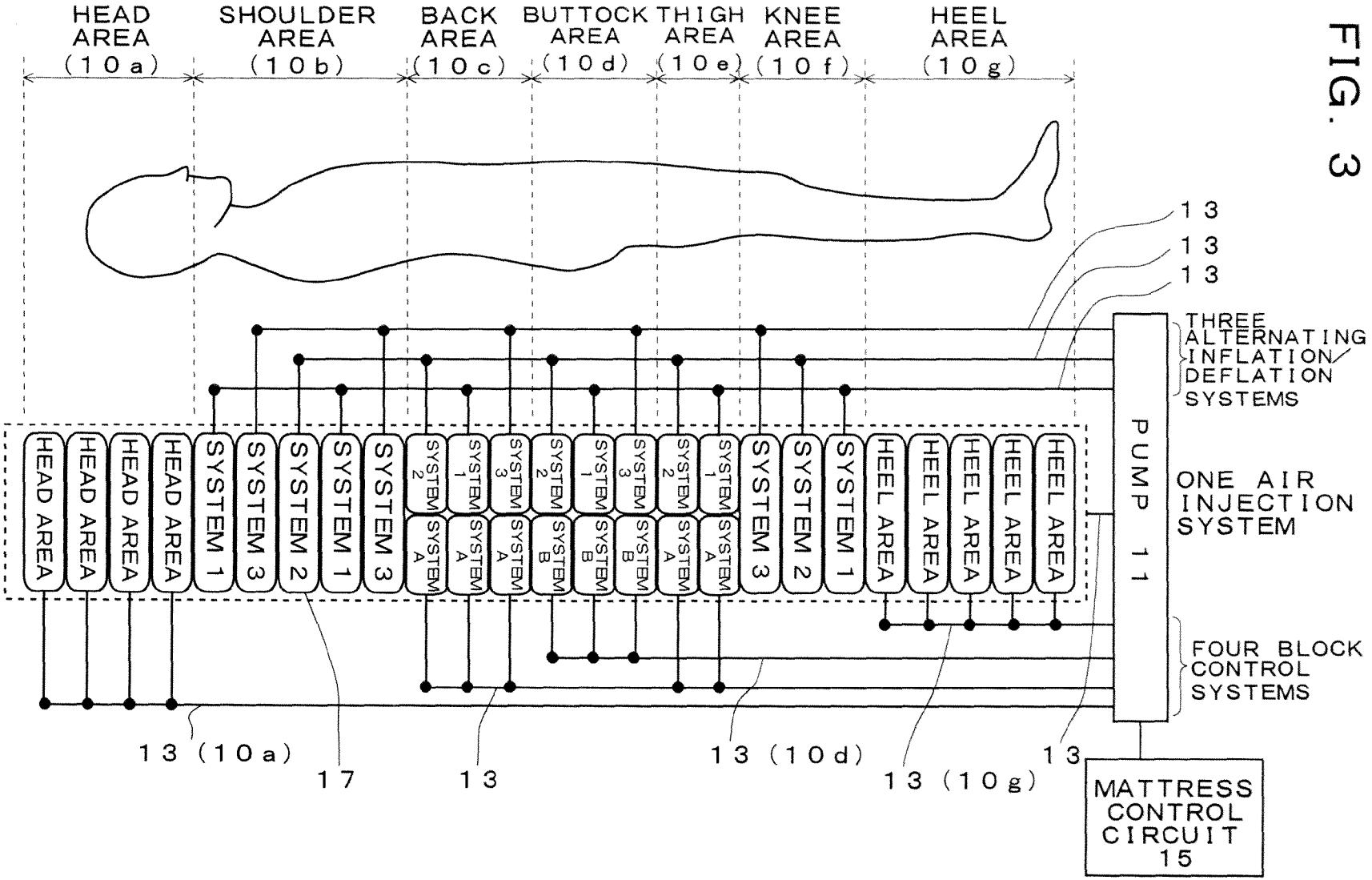
FIG. 3 is a schematic view of air supply/release systems for each of the bladder-shaped cells of an air mattress with an internal pump according to an embodiment of the present invention.
Figure 4:
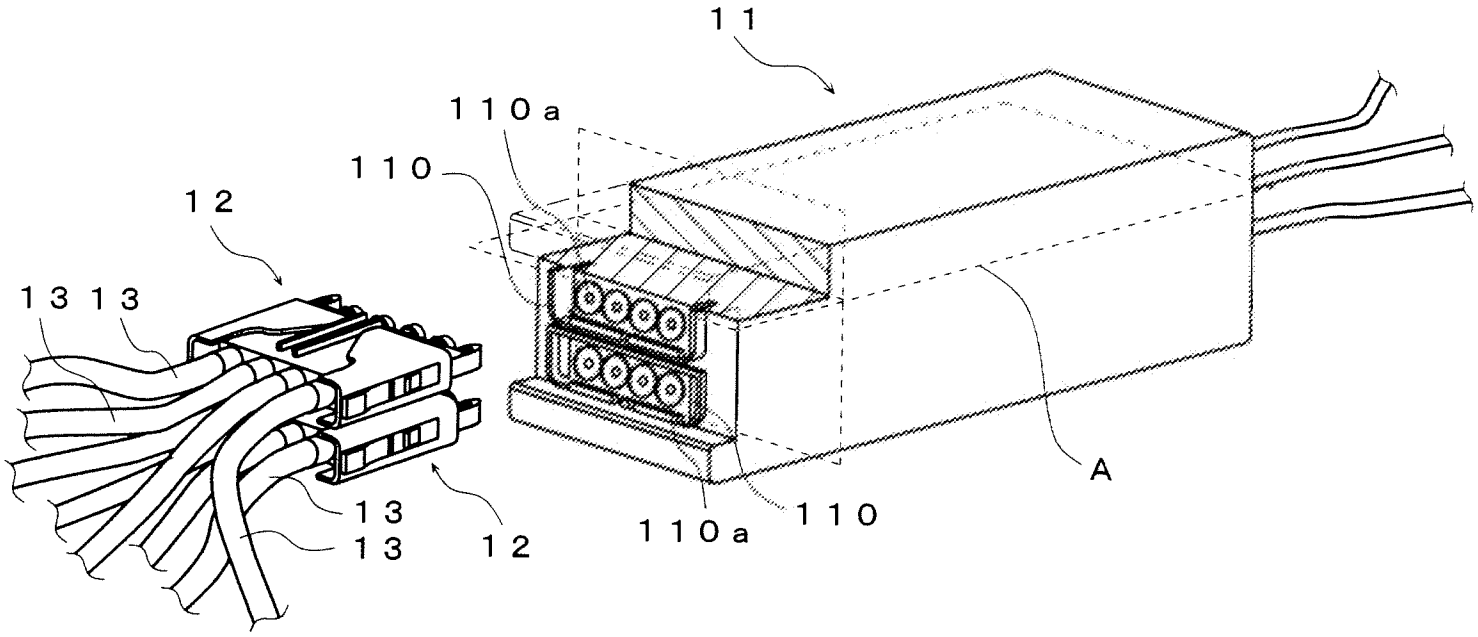
FIG. 4 is a perspective view of an air supply/release pump and a connector of an air mattress with an internal pump according to an embodiment of the present invention.
Figure 5:
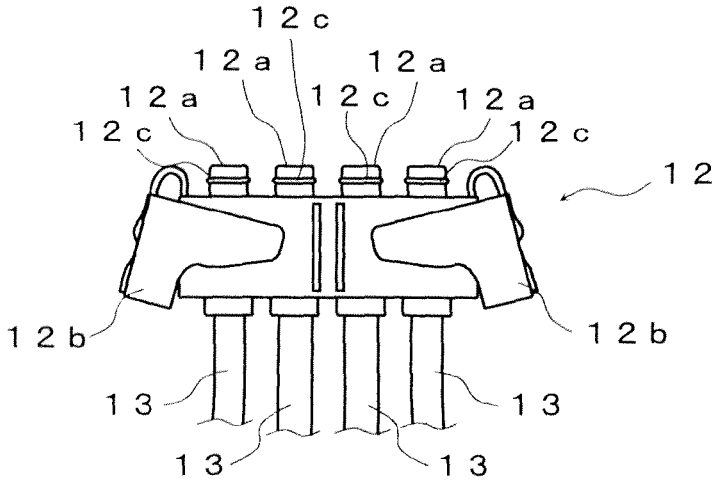
FIG. 5 is a plan view of an air tube-side connector of an air mattress with an internal pump according to an embodiment of the present invention.
Figure 6:
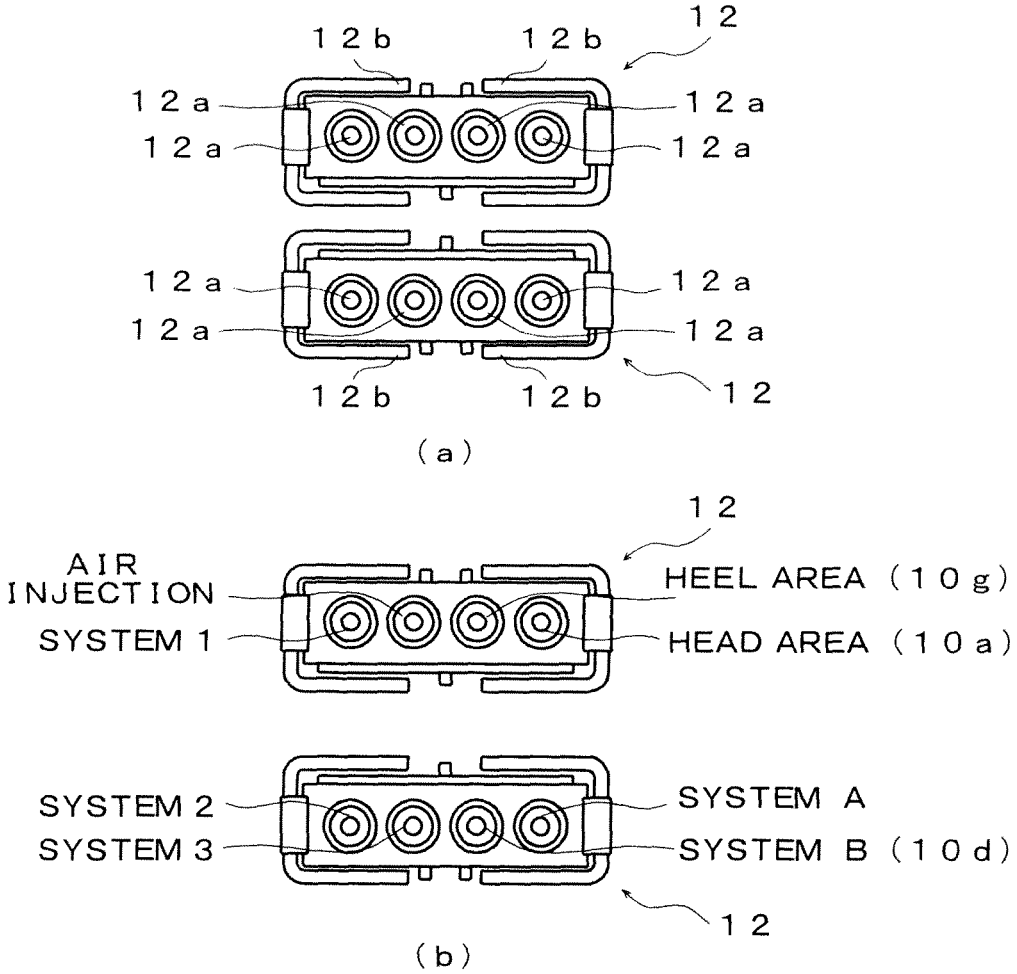
FIGS. 6(*a*) and 6(*b*) are views of an air tube-side connector of an air mattress with an internal pump according to an embodiment of the present invention as seen from a mating surface side thereof.
Figure 7:
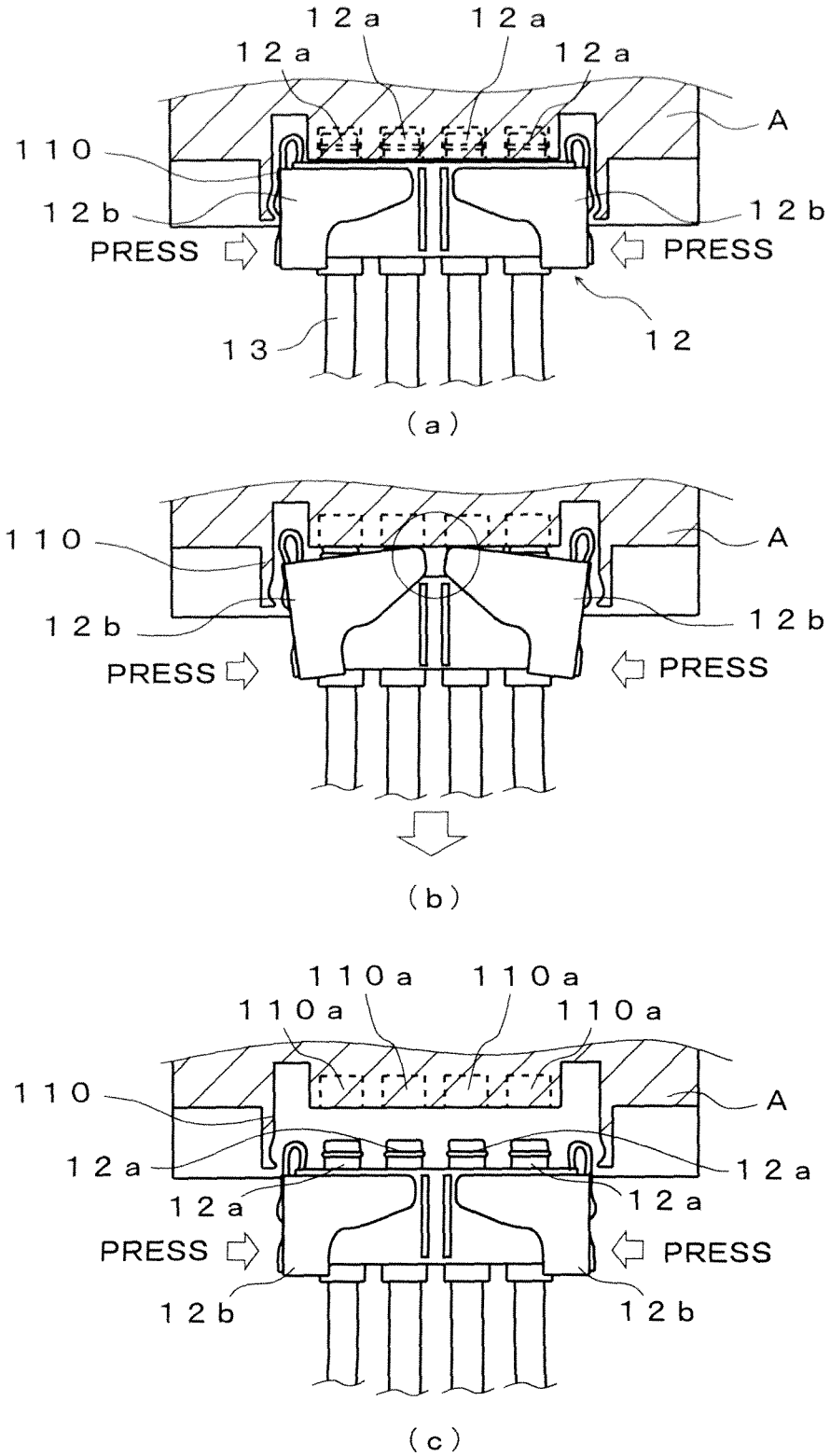
FIGS. 7(*a*) through 7(*c*) are partial plan views illustrating a process of removing a connector of an air mattress with an internal pump according to an embodiment of the present invention.

Hereafter follows a detailed description of an air mattress with an internal pump according to an embodiment of the present invention with reference to the attached drawings. FIG. 1 is a perspective view of an air mattress with an internal pump according to an embodiment of the present invention, FIG. 2 is a plan view of the disposition of each of the bladder-shaped cells and an air supply/release pump of the air mattress with an internal pump according to an embodiment of the present invention, and FIG. 3 is a schematic view of air supply/release systems for each of the bladder-shaped cells of the air mattress with an internal pump according to an embodiment of the present invention. FIG. 4 is a perspective view of an air supply/release pump and a connector of the present embodiment, FIG. 5 is a plan view of an air tube-side connector of the present embodiment, FIGS. 6(*a*) and 6(*b*) are views of the air tube-side connector of the present embodiment as seen from a mating surface side thereof, and FIG. 7 is a partial plan view illustrating a process of removing the connector of the air mattress with an internal pump according to the present embodiment, and is a cross-sectional view along plane A in FIG. 4.

First, the configuration of the air mattress with an internal pump according to the present embodiment will be described. As shown in FIGS. 1 through 3, an air mattress with an internal pump 1 according to the present invention is provided with a plurality of air cell groups 10 constituted by a plurality of bladder-shaped cells and lined up in the lengthwise direction of the air mattress, an air supply/release pump 11, and an air tube 13 connecting the bladder-shaped cells of each of the air cell groups 10 to the air supply/release pump 11; and the plurality of air cell groups 10, the air tube 13, and the air supply/release pump 11 together constitute an integrated whole.

As shown in FIG. 2, each of bladder-shaped cells 17 of the plurality of air cell groups 10 are rod-shaped cells extending in the widthwise direction of the air mattress 1, and the plurality of bladder-shaped cells 17 is lined up in the lengthwise direction of the air mattress to constitute the main body of the air mattress. As shown in FIG. 2 and FIG. 3, a plurality of bladder-shaped cells is disposed corresponding to each of a head area, a shoulder area, a buttock area, a thigh area, a knee area, and a heel area of a person lying on the air mattress. In the present embodiment, as shown in FIG. 3, the bladder-shaped cells 17 corresponding to the back area, buttock area, and thigh area of the mattress user are divided into upper sections and lower sections, and the air pressure for each is controlled by different systems. Each of the bladder-shaped cells 17 are, for example, formed by stitching together resin members of nylon fibers or the like, and bladder-shaped cells disposed adjacent to one another are fixed together by, for example, being stitched together. The fixing together of bladder-shaped cells may also be performed using, for example, an adhesive. In this way, the air mattress 1 supports the body of a person lying on the mattress by having the plurality of rod-shaped cells extending in the widthwise direction of the air mattress be lined up in the lengthwise direction of the air mattress, and the interior of each of the bladder-shaped cells be filled with air. By adjusting the air pressure within the bladder-shaped cells according to the part of the body, it is possible, for example, to cause the pressure within the bladder-shaped cells for the back area and the thigh area to be greater than the pressure within the bladder-shaped cells for the buttock area, thus enabling dispersion of body pressure. Each of the plurality of bladder-shaped cells 17 is provided at least one location with an air supply/release terminal for connecting to the air tube 13. In the present embodiment, each of the bladder-shaped cells is provided with an air supply/release terminal at one location, and each bladder-shaped cell is configured so as to be capable of being inflated and deflated by connecting the air tube 13 to the air supply/release terminal and supplying air to or releasing air from the bladder-shaped cell via the air tube 13 of each system. The air tube 13 used is preferably manufactured, for example, from a resin such as vinyl chloride.

In the present embodiment, as shown in FIG. 3, the plurality of bladder-shaped cells in an air cell group 10*a*, which corresponds to the head area of a person lying on the air mattress, is connected to a shared air tube 13 so that air is supplied or released through a single independent air supply/release system, and the plurality of bladder-shaped cells in an air cell group 13*g*, which corresponds to the heel area, is connected to a shared air tube 13 so that air is supplied or released through a single independent air supply/release system. Furthermore, out of the bladder-shaped cells of an air cell group 10*c* corresponding to the back area of a person lying on the air mattress, the bladder-shaped cells in a lower section are connected to an air tube 13 shared with the bladder-shaped cells in a lower section of an air cell group 10*e* corresponding to the thigh area, and are configured so that air is supplied or released through a single independent air supply/release system (system A). Likewise, the bladder-shaped cells in a lower section of an air cell group 10*d* corresponding to the buttock area is connected to a shared air tube 13 so that air is supplied or released through a single independent air supply/release system (system B). In the present embodiment, the plurality of bladder-shaped cells of an air cell group 10*b* corresponding to the shoulder area of a person lying on the air mattress is connected to one of three independent air supply/release systems (system 1, system 2, and system 3) via an air tube 13, and is thereby configured so that independent air supply or release is performed for each. Likewise, the pluralities of bladder-shaped cells of air cell groups 10*c* through 10*f* corresponding to the back area (upper section), buttock area (upper section), thigh area (upper section), and knee area are connected to one of the three independent air supply/release systems (system 1, system 2, and system 3) via an air tube 13, and are thereby configured so that independent air supply or release is performed for each. As shown in FIG. 3, the bladder-shaped cells of each of the three air supply/release systems are disposed in alternation in the order system 1, system 3, system 2, system 1, system 3 . . . from the shoulder area to the knee area. Bladder-shaped cells in the same air supply/release system (system 1, system 2, or system 3) are each connected to a shared air tube 13. Furthermore, in the present embodiment, an injection air tube 13 for supplying air to one independent system is laid on a lower surface of the mattress, and is configured so that, by supplying air to the injection air tube, air is ejected from a plurality of injection holes provided on an external surface of the injection air tube, enabling moisture to be removed from the mattress. Specifically, the present embodiment is provided with four air supply/release systems for controlling blocks for the head area, heel area, buttock area (lower section), and back area (lower section) and thigh area (lower section) of the mattress user; with three air supply/release systems—system 1, system 2, and system 3—for alternating inflation/deflation; and with one air supply system for injecting air, for a total of eight air supply/release systems. It is thereby possible to individually adjust the air pressure within the bladder-shaped cells according to the part of the body, thus dispersing body pressure. For example, the pressure within the bladder-shaped cells of air cell groups 10*c*, 10*e* for the back area and thigh area is set to be greater than the pressure within the bladder-shaped cells of air cell group 10*d* for the buttock area. A pressure sensor for measuring interior pressure is provided for each of the bladder-shaped cells as necessary, and is configured so that the value measured by the pressure sensor is outputted to a control circuit 15 provided within a hand switch to be described below or within the air supply/release pump 11. In this case, either a pressure sensor is provided for all of the bladder-shaped cells, or a shared pressure sensor is provided for bladder-shaped cells within the same system.

As shown in FIG. 2, out of the bladder-shaped cells of the plurality of air cell groups 10, the bladder-shaped cells of air cell group 10*g*, which is disposed in correspondence to the heel area of a person lying on the air mattress, are shorter than the bladder-shaped cells of the other air cell groups (10*a* through 10*f*), and the bladder-shaped cells of the other air cell groups 10 extend to the edge of the air mattress. Thus, there is a space left between the bladder-shaped cells of air cell group 10*g*, which corresponds to the heel area, and the edge of the air mattress. In the present embodiment, the bladder-shaped cells of air cell group 10*g*, which is disposed in correspondence to the heel area of a person lying on the air mattress, are shorter than the other bladder-shaped cells by at least the width of an air supply/release pump 11 described below, and are shorter than the other bladder-shaped cells by up to 30%. In other words, in the collection of bladder-shaped cells in which a plurality of bladder-shaped cells is arranged and formed so as to describe a rectangle as a whole when seen in a plan view, out of the four corners thereof, there is a space left in one of the corners by the heel area of the person lying on the air mattress in which bladder-shaped cells are not disposed.

The air supply/release pump 11 is disposed within the space in which bladder-shaped cells are not disposed so that the lengthwise direction thereof is parallel with the lengthwise direction of the air mattress 1; i.e., so that the lengthwise direction is orientated in the direction from the head area to the leg area of the person lying on the air mattress. The air supply/release pump 11 is thereby disposed in a corner out of the four corners of the air mattress 1, which is configured so as to describe a rectangle as a whole when seen in a plan view, that corresponds to the heel area of the person lying on the mattress. The part corresponding to the side of the heel area is a part that the body of the user of the air mattress does not readily contact even if the user turns over while sleeping, so that comfort is not reduced. Even if the user does come in contact with this part, because it is the heel, comfort is not negatively affected by the presence of the pump. It is also possible to cover the exterior surface of the air supply/release pump 11 with a flexible member made of, for example, urethane so that, even when the heel of the person on the air mattress is positioned over the air supply/release pump 11 due to the person rolling over or the like, the flexible member acts as a cushion, thereby preventing a reduction in comfort. It is also possible to protect the air supply/release pump 11 from shock from the heel using the flexible member, so that the functioning of the mattress is not impeded. The flexible member used is preferably a member with high body pressure dispersibility. This enables the risk of decubitus ulcer occurrence to be reduced. Because the air supply/release pump 11 is disposed at a part corresponding to the heel area of the air mattress user, the comfort of the mattress user is not reduced by the operating noise of the pump.

In the present embodiment, the air supply/release pump 11 is provided in an area within the range of the width and length of the air mattress formed from the plurality of air cell groups 10; thus, the pump fits within the space occupied by a conventional air mattress, does not require installation outside of the air mattress, and is easy to handle. Because the air supply/release pump is provided in a corner corresponding to the heel area of the air mattress user, the air mattress according to the present embodiment can be laid on the frame of a bed having, for example, knee-raising and knee-lowering functions, and used. In other words, when the air mattress is laid on the frame of a bed having knee-raising and knee-lowering functions, the air supply/release pump 11 is not disposed at a part of the air mattress that bends, and the knee-raising and knee-lowering operations of the bed are not impeded by the presence of the air supply/release pump. The height of the air supply/release pump 11 is preferably equal to or less than that of the bladder-shaped cells of each of the air cell groups 10. This makes it possible to prevent the air supply/release pump 11, which is harder than the air-filled bladder-shaped cells, from jutting out beyond the air cell groups 10 in the height direction, as well as to prevent the position of the person lying on the air mattress from being higher than that of the side rails when the air mattress is provided on a bed having, for example, side rails.

In the present embodiment, as shown in FIG. 1, the plurality of air cell groups 10 and the air supply/release pump 11 are covered by a single top cover 14, and the upper surfaces thereof are protected. The top cover 14 comprises, for example, nylon fibers coated with polyurethane, and is water repellent. By protecting the upper surfaces of the air cell groups 10 and the air supply/release pump 11 with the top cover 14, it is possible to prevent, for example, the interior of the mattress from being soiled by waste from the mattress user, or mold and odors from being generated within the mattress. It is also possible to improve the water resistance of the electronic circuitry part of the air supply/release pump 11 using the top cover 14, and it is easier to clean the upper surface of the air mattress. Because the upper surfaces of the air cell groups 10 and the air supply/release pump 11 are covered with the top cover 14, the lower surface of the air supply/release pump 11 is exposed to the exterior at one side surface in the widthwise direction of the air mattress 1 and a side surface corresponding to the leg area of the mattress user in the lengthwise direction of the air mattress 1. When the top cover 14 is provided, as in the case of the present embodiment, it is possible to provide the collection of air cell groups formed by the plurality of air cell groups 10 and/or the air supply/release pump 11 with a structure so that the top cover 14 can be fixed thereto. In this case, the air supply/release pump 11 may be fixed to the air cell groups 10. Even in cases where no top cover 14 is provided, it is possible to provide a structure for fixing the air supply/release pump 11 to the air cell groups 10. For example, it is possible to provide the air cell group 10*g* corresponding to the heel area with a ring- or belt-shaped structure, and to wrap a ring member or belt member around the outer periphery of the air supply/release pump 11 and fix the air supply/release pump 11 to the air cell groups 10.

As shown in FIG. 1, the air supply/release pump 11 is provided on, for example, a side exposed to the exterior on an end of the air mattress 1 in the lengthwise direction with one each of a power input cord, an input/output signal cord leading to a hand switch for operating the mattress, and a cord for sending and receiving signals connected to a control circuit of the bed. A configuration is thus obtained in which the air supply/release pump 11 is driven by power supplied from a power source, and the supply or release of air to and from each of the air tubes 13 is controlled by the input/output of signals from the hand switch or the input/output of signals from the control circuit of the bed. In the present embodiment, the hand switch (not shown) is provided with a switch for switching between various pressures of the mattress, such as a decubitus ulcer prevention mode in which the amount of air supplied to and released from the bladder-shaped cells connected to the air tubes 13 of system 1, system 2, and system 3 is continuously varied so as to alternatingly inflate and deflate adjacent cells from the shoulder area to the knee area of the person lying on the mattress, thus preventing a fixed amount of pressure from being placed on a part of the body of the mattress user; and it is possible to control the amount of air being supplied to and released from the air tubes 13 of the seven air supply/release systems and one air injection system described above by input signals from the hand switch, thereby controlling the pressure within the bladder-shaped cells connected to the air tubes 13 of each of the air supply systems. Along with the decubitus ulcer prevention mode switch, the hand switch is provided with a transport mode switch for sealing the air release holes so as not to release the air within each of the bladder-shaped cells of the air mattress when, for example, the air mattress is being transported with a person lying thereupon.

In the present embodiment, as shown in FIG. 4, the air tubes 13 are connected to the air supply/release pump 11 via a connector. An air supply/release pump-side connector 110 is provided in two locations on, for example, a side of the air supply/release pump 11 in the lengthwise direction opposite to that of the power cord. In the present embodiment, each of the air supply/release pump-side connectors 110 is provided with four air supply/release mouths 110*a*; and of the total of eight air supply/release mouths 110*a* provided on the air supply/release pump 11, seven are configured as air supply/release mouths for supplying and releasing air to and from the bladder-shaped cells connected to the head area, heel area, systems 1 through 3, and systems A and B via the air tubes 13. The remaining one of the eight air supply/release mouths 110*a* is configured as an air supply mouth, and it is possible to expel air from the plurality of injection holes provided on the external surface of the injection air tube by supplying air to the injection air tube provided on the lower surface of the mattress, and for moisture to be removed from the mattress. In the present embodiment, as shown in FIG. 5, an air tube-side connector 12 can connect four air tubes; thus, by connecting two air tube-side connectors 12 to the air supply/release pump 11 as shown in FIG. 4, the pressure within each of the bladder-shaped cells is controlled by the seven air supply/release systems via the air tubes 13 for each of the systems, and moisture is removed from the mattress by the one air injection system. FIG. 6(*b*) illustrates an example of a disposition of air intake/release terminals 12*a* corresponding to the eight air supply/release systems.

As shown in FIG. 4, each of the two air supply/release pump-side connectors 110 is provided with four air supply/release mouths 110*a*; and by inserting the air intake/release terminals 12*a* of the air tube-side connectors 12 shown in FIG. 5 into the air supply/release mouths 110*a* and engaging a projection on a side surface of a connector cover 12*b* with an indentation on an interior surface of each of the air supply/release pump-side connectors 110, the air tube-side connectors 12 are mated with the air supply/release pump-side connectors 110. Rubber seals 12*c* are provided on exterior surfaces of the air intake/release terminals 12*a* of the air tube-side connectors 12, increasing the strength of the seal between the air supply/release mouths 110*a* and the air intake/release terminals 12*a*.

The present embodiment is configured so that, when the connectors 12 are removed from the air supply/release pump 11 as shown in FIG. 7, the connections between all of the air tubes 13 and each of the eight air supply/release systems are released, thus releasing control of the pressure within the bladder-shaped cells, and the air within all of the bladder-shaped cells is rapidly released through the air tubes 13 of each of the air supply/release systems.

As shown in FIG. 7(*a*) and FIG. 7(*b*), the connector 12 of the present embodiment is configured so that front edges of the connector covers 12*b* project in directions facing away from each other; and when rear edges of the connector covers 12*b* are pressed in directions approaching each other, the projecting tips of the connector covers 12*b* press upon the surface upon which the air supply/release mouths of the air supply/release pump-side connectors 110 are provided (the mating surface), as shown in FIG. 7(*b*), at the same time that the projections on the sides of the connector covers 12*b* and the indentations on the inner surface of the air supply/release pump-side connector 110 disengage.

Next, the operation of the air mattress with an internal pump according to the present embodiment will be described. In the present embodiment, when a caretaker or the like operates the switch on the hand switch and switches the operation of the air mattress 1 to, for example, decubitus ulcer prevention mode while a mattress user is reclining upon the top cover 14 of the mattress 1, an input signal from the hand switch is inputted to a mattress control circuit 15 provided within the hand switch or within the air supply/release pump 11. The control circuit 15 then sends a signal controlling, for example, the rotations per minute or other parameters of an electromagnetic motor provided within the air supply/release pump 11, thereby adjusting the amount of air supplied and released to and from the air tubes 13 connected to each of the air supply/release systems of the air supply/release pump, in turn controlling the pressure within the bladder-shaped cells connected to the air tubes 13 of each of the air supply systems.

At this time, the control circuit controls the pressure within the bladder-shaped cells corresponding to each of the air tubes 13 connected, for example, to the four block control air supply systems so that the pressure is constantly at a fixed amount. In other words, when the body weight of the person lying on the mattress is, for example, from 30 to 135 kg, each of the air cell groups is separately controlled so that the pressure within the bladder-shaped cells of air cell group 10*a*, which corresponds to the person's head area, is for example from 1.6 to 4.3 kPa; the pressure within the bladder-shaped cells of air cell group 10*g*, which corresponds to the person's heel area, is for example from 1.1 to 3.0 kPa; the pressure within the bladder-shaped cells of the lower sections of air cell groups 10*c* and 10*e* (system A), which correspond to the person's back area and thigh area, is from 1.5 to 6.4 kPa; and the pressure within the bladder-shaped cells of the lower section of air cell group 10*d* (system B), which corresponds to the person's buttock area, is from 1.1 to 3.3 kPa. By controlling the pressure within the bladder-shaped cells of air cell group 10*a* and 10*g*, which correspond to the head area and the heel area of the mattress user, so that the pressure is a fixed amount, it is possible to stably support the locations corresponding to bones protruding outward from the back area of the body of the mattress user (the occipital and calcaneal bones) when the user is in a reclined state. By controlling the pressure within the bladder-shaped cells of the lower sections of air cell group 10*c* and 10*e* (system A), which correspond to the back area and thigh area of the mattress user, so as to be greater than the pressure within the bladder-shaped cells of the lower section of air cell group 10*d* (system B), which corresponds to the buttock area, it is possible to stably support the buttock area, which protrudes toward the mattress and thus receives a larger load of the body's weight compared to other locations when the user is in a reclined state, from both sides, i.e., using the bladder-shaped cells of air cell group 10*c* and 10*e*, which correspond to the back area and the thigh area. This, in turn, makes it possible to prevent the pressing force from the bladder-shaped cells of the air cell group 10*d* corresponding to the buttock area from becoming too great, promoting dispersion of body pressure.

Meanwhile, for example, with regard to the air tubes 13 of the three alternating inflation/deflation air intake systems, the control circuit first sets the amount of air supplied to the air tube 13 of the air intake/release system of system 1 to an amount smaller than the amount supplied to the air tubes 13 of the air intake/release systems of system 2 and system 3, and sets the amount of air being supplied to the air tubes 13 of system 2 and system 3 to roughly equal levels. The pressure within the bladder-shaped cells connected to the air tubes of system 1 thereby becomes the smallest, and the pressure within the bladder-shaped cells connected to the air tubes of system 2 becomes roughly equal to the pressure within the bladder-shaped cells connected to the air tubes of system 3 and greater than the pressure within the bladder-shaped cells of system 1. At this time, in cases where a pressure sensor is provided in the bladder-shaped cells of each of the systems, the control circuit increases or decreases the amount of air supplied to each of the systems on the basis of the measured values outputted from the pressure sensors as appropriate, allowing the pressure within the bladder-shaped cells connected to the air tubes 13 of each of the systems to be rapidly set to a predetermined set value.

After maintaining the internal pressure of the bladder-shaped cells connected to the air tubes 13 of each of the three alternating inflation/deflation systems in this state for a predetermined period of, for example, 460 seconds or less, the control circuit controls the amount of air supplied or released by the seven air supply/release systems, thereby increasing the pressure within the bladder-shaped cells of system 1, decreasing the pressure within the bladder-shaped cells of system 2, and maintaining the pressure within the bladder-shaped cells of system 3 at a fixed level. During a pressure transition period of, for example, 170 seconds or less, the pressure within the bladder-shaped cells of system 2 thereby becomes the smallest, and the pressure within the bladder-shaped cells of system 1 and the pressure within the bladder-shaped cells of system 3 become roughly equal to each other and greater than the pressure within the bladder-shaped cells of system 2. The pressure within the bladder-shaped cells corresponding to the head area, back area (lower section), buttock area (lower section), thigh area (lower section), and heel area are maintained at a fixed level.

In this state, the control circuit controls the internal pressure of each of the bladder-shaped cells according to a method similar to that described above. In other words, the control circuit controls the pressure within each of the bladder-shaped cell by controlling the amount of air being supplied or released by the seven air supply/release systems after a predetermined period of, for example, 460 seconds or less so that, during a pressure transition period of 170 seconds or less, the pressure thin the bladder-shaped cells of system 3 becomes the smallest, and the pressure within the bladder-shaped cells of system 1 and the pressure within the bladder-shaped cells of system 2 become roughly equal to each other and greater than the pressure within the bladder-shaped cells of system 3. The pressure within the bladder-shaped cells corresponding to the head area, back area (lower section), buttock area (lower section), thigh area (lower section), and heel area are maintained at a fixed level.

By controlling the pressure within the bladder-shaped cells connected to the air tubes 13 of each of the air supply/release systems, it is possible to continuously vary the pressure within the bladder-shaped cells of the air cell groups 10 corresponding to the parts where the skin contacts the mattress surface, i.e., the shoulder area, back area, buttock area, thigh area, and knee area when the mattress user is in a reclined state, thereby preventing the same amount of pressure from being placed on specific parts of the skin for long periods of time, and thus decubitus ulcers from occurring.

When performing medical or caretaking work upon the mattress user, a caretaker or the like can, for example, stop the decubitus ulcer prevention function of the air mattress by operating the switch on the hand switch. In other words, either the pressure within each of the bladder-shaped cells is maintained at a fixed level while the decubitus ulcer prevention function of the air mattress is in operation, the pressure within the bladder-shaped cells connected to the air tubes 13 of each of the systems is set to a pressure suitable for medical or caretaking work or the like and maintained at the set pressure, or the pressure within all of the bladder-shaped cells is set to the same level and maintained at the set pressure.

In the air mattress 1 according to the present embodiment, the air supply/release pump 11 is contained within the mattress. Thus, medical and caretaking work or the like is not impeded by an air supply/release pump provided outside of the mattress, and the ease of performing this work can be improved.

When there is a need to perform emergency medical treatment, such as cardiac massage or the like, upon the mattress user, the elasticity of the air mattress may impede the medical treatment. When this happens, the air tubes are detached from the air supply/release pump. In the air mattress with an internal pump according to the present embodiment, the air tubes 13 are connected to the air supply/release pump 11 via the connector 12. As shown in FIG. 7(*a*) through FIG. 7(*c*), the connector 12 of the present embodiment is configured so that when rear edges of the connector covers 12*b* are pressed in directions approaching each other, the projecting tips of the connector covers 12*b* press upon the surface upon which the air supply/release mouths of the air supply/release pump-side connectors 110 are provided (the mating surface), as shown in FIG. 7(*b*), at the same time that the projections on the sides of the connector covers 12*b* and the indentations on the inner surfaces of the air supply/release pump-side connectors 110 disengage. Thus, a caretaker or the like can quickly remove the connector 12 from the air supply/release pump 11 simply by pressing the sides of the connector 12, thereby enabling smooth release of air from all the bladder-shaped cells.

When the air mattress is set, for example, upon a bed, and there is a need to move the mattress user along with the bed, after, for example, a transport mode switch provided on the hand switch is pressed, a plug at the tip of the power cord of the air supply/release pump 11 is removed from a power supply source such as, for example, an electrical socket. The air supply/release pump 11 is configured so that, by pushing the transport mode button on the hand switch, the air supply/release mouths are closed so that air is not released from, for example, each of the air supply release systems, and the pressure within each of the bladder-shaped cells is maintained at a fixed level. Large depressions due to depressurization of the bladder-shaped cells when the mattress user is being transported are thereby prevented, and thus the occurrence of decubitus ulcers due to the buttock area of the mattress user being compressed by the frame of the bed is prevented.

In the air mattress 1 according to the present embodiment, because the air supply/release pump 11 is disposed at a corner of the mattress, it is easy to contact the air supply/release pump 11 when performing maintenance upon the air supply/release pump 11 and the air tubes 13 when the air mattress is not in use. In this case, when the air tubes 13 are detached from the air supply/release pump 11, if the air supply/release pump 11 is configured so as to be removable from the mattress, maintenance of the air supply/release pump 11 and the air tubes 13 becomes even easier.

In the present invention, as described above, the air supply/release pump is disposed in the space left between the air cell groups corresponding to the heel area of the person lying on the air mattress and the edge of the mattress, the body of the air mattress user does not readily come into contact with the air supply/release pump even if the user turns over while sleeping, and comfort is not negatively affected. Also, because the air supply/release pump is provided at a corner of the mattress within the range of the width and length of the air mattress constituted by the plurality of air cell groups, the pump fits within the space occupied by a conventional air mattress, does not require installation outside of the air mattress, and is easy to handle.

Thus, medical and caretaking work or the like is not impeded by the air supply/release pump, and the ease of performing this work can be improved. Moreover, because the area of the air supply/release pump exposed to the exterior is kept to a minimum, maintenance of the air supply/release pump and air tubes is easy, while the risk of the air supply/release pump and air tubes breaking is reduced.

INDUSTRIAL APPLICABILITY

The present invention is an air mattress in which the position of the pump has been improved, thus allowing comfort, ease of performing caretaking work, and ease of maintenance to be increased.

KEY

1: Air mattress (with internal pump)
10: Air cell group
11: Air supply/release pump
110: Connector (air supply/release pump-side)
110*a*: Air supply/release mouth
12: Air tube-side connector
12*a*: Air supply/release terminal
12*b*: Connector cover
12*c*: Rubber seal
13: Air tube
14: Top cover
2: Electric bed
2*a*: Electric bed control circuit
2*b*: Actuator

The invention claimed is:

1. An air mattress with an internal pump, comprising:

a plurality of air cell groups lined up in a lengthwise direction of the air mattress, each of which groups is made from a plurality of bladder-shaped cells;

an air supply/release pump provided with a power input cord and at least one signal cord;

an air tube linking said air cell groups and said air supply/release pump in an independent system for each air cell group of two or more air cell groups out of said air cell groups for supplying or releasing air to and from said air cell groups;

a first connector provided with air supply/release mouths connected to said air tube in said independent system for each air cell group; and a second connector provided with air supply/release mouths provided on and connected to said air supply/release pump in said independent system for each air cell group, said second connector being detachably connected to said first connector, wherein all of the bladder-shaped cells of said air cell groups are rod-shaped cells extending in a widthwise direction of the air mattress, and each of said air cell groups is configured so that the bladder-shaped cells are lined up in the lengthwise direction of the air mattress, wherein the bladder-shaped cells of the air cell groups other than the air cell groups corresponding to a heel area of a person lying on the air mattress extend to an edge of said air mattress, wherein the length of the bladder-shaped cells of the air cell groups corresponding to said heel area is up to 30% less than that of the other bladder-shaped cells, and a space is left between the cells and the edge of said air mattress, wherein said air supply/release pump is disposed in said space, and wherein, when the air supply/release mouths of the first connector are detached from the air supply/release mouths of the second connector, connections between said air tube in said independent system for each air cell group are released, thereby releasing control of a pressure within the bladder-shaped cells, and air within all of the bladder-shaped cells is released through said air tube.

2. The air mattress with an internal pump according to claim 1, wherein the pressure within the bladder-shaped cells can be controlled individually for each of the air cell groups among the air cell groups linked in independent systems by said air tubes.

3. The air mattress with an internal pump according to claim 2, wherein an exterior surface of said air supply/release pump is covered by a flexible member.

4. The air mattress with an internal pump according to claim 2, further comprising a top cover for covering upper surfaces of said plurality of air cell groups and said air supply/release pump.

5. The air mattress with an internal pump according to claim 2, wherein, when the air supply/release mouths of the first connector are detached from the air supply/release mouths of the second connector, connections between the air tube in said independent system for each air cell group are released.

6. The air mattress with an internal pump according to claim 2, wherein the first connector includes a pair of connector covers disposed such that front edges of the connector covers project in directions facing away from each other.

7. The air mattress with an internal pump according to claim 1, wherein an exterior surface of said air supply/release pump is covered by a flexible member.

8. The air mattress with an internal pump according to claim 7, further comprising a top cover for covering upper surfaces of said plurality of air cell groups and said air supply/release pump.

9. The air mattress with an internal pump according to claim 1, further comprising a top cover for covering upper surfaces of said plurality of air cell groups and said air supply/release pump.

10. The air mattress with an internal pump according to claim 1, wherein, when the air supply/release mouths of the first connector are detached from the air supply/release mouths of the second connector, the connections between said air tube in said independent system for each air cell group are released.

11. The air mattress with an internal pump according to claim 1, wherein the first connector includes a pair of connector covers disposed such that front edges of the connector covers project in directions facing away from each other.

12. An air mattress with an internal pump, comprising:

a plurality of air cell groups lined up in a lengthwise direction of the air mattress, each of which groups is made from a plurality of bladder-shaped cells;

an air supply/release pump provided with a power input cord and at least one signal cord;

an air tube linking said air cell groups and said air supply/release pump in an independent system for each air cell group of two or more air cell groups out of said air cell groups for supplying or releasing air to and from said air cell groups;

a first connector provided with air supply/release mouths connected to said air tube in said independent system for each air cell group; and a second connector provided with air supply/release mouths provided on and connected to said air supply/release pump in said independent system for each air cell group, said second connector being detachably connected to said first connector, wherein all of the bladder-shaped cells of said air cell groups are rod-shaped cells extending in a widthwise direction of the air mattress, and each of said air cell groups is configured so that the bladder-shaped cells are lined up in the lengthwise direction of the air mattress, the bladder-shaped cells of the air cell groups other than the air cell groups corresponding to a heel area of a person lying on the air mattress extend to an edge of said air mattress, the length of the bladder-shaped cells of the air cell groups corresponding to said heel area is up to 30% less than that of the other bladder-shaped cells, and a space is left between the cells and the edge of said air mattress, said air supply/release pump is disposed in said space, wherein the first connector includes a pair of connector covers disposed such that front edges of the connector covers project in directions facing away from each other, and wherein the connector covers press upon a surface upon which the air supply/release mouths of the second connector are provided so as to attach the first connector to the second connector.

13. An air mattress with an internal pump, comprising:

a plurality of air cell groups lined up in a lengthwise direction of the air mattress, each of which groups is made from a plurality of bladder-shaped cells;

an air supply/release pump provided with a power input cord and at least one signal cord;

an air tube linking said air cell groups and said air supply/release pump in an independent system for each air cell group of two or more air cell groups out of said air cell groups for supplying or releasing air to and from said air cell groups;

a first connector provided with air supply/release mouths connected to said air tube in said independent system for each air cell group; and a second connector provided with air supply/release mouths provided on and connected to said air supply/release pump in said independent system for each air cell group, said second connector being detachably connected to said first connector, wherein all of the bladder-shaped cells of said air cell groups are rod-shaped cells extending in a widthwise direction of the air mattress, and each of said air cell groups is configured so that the bladder-shaped cells are lined up in the lengthwise direction of the air mattress, wherein the bladder-shaped cells of the air cell groups other than the air cell groups corresponding to a heel area of a person lying on the air mattress extend to an edge of said air mattress, wherein the length of the bladder-shaped cells of the air cell groups corresponding to said heel area is up to 30% less than that of the other bladder-shaped cells, and a space is left between the cells and the edge of said air mattress, wherein said air supply/release pump is disposed in said space, wherein the first connector includes a pair of connector covers disposed such that front edges of the connector covers project in directions facing away from each other, wherein the connector covers press upon a surface upon which the air supply/release mouths of the second connector are provided so as to attach the first connector to the second connector, and wherein the first and second connector covers are configured to be pressed so as to detach the first connector from the second connector.

14. An air mattress with an internal pump, comprising:

a plurality of air cell groups lined up in a lengthwise direction of the air mattress, each of which groups is made from a plurality of bladder-shaped cells;

an air supply/release pump provided with a power input cord and at least one signal cord;

an air tube linking said air cell groups and said air supply/release pump in an independent system for each air cell group of two or more air cell groups out of said air cell groups for supplying or releasing air to and from said air cell groups;

a first connector provided with air supply/release mouths connected to said air tube in said independent system for each air cell group; and a second connector provided with air supply/release mouths provided on and connected to said air supply/release pump in said independent system for each air cell group, said second connector being detachably connected to said first connector, wherein all of the bladder-shaped cells of said air cell groups are rod-shaped cells extending in a widthwise direction of the air mattress, and each of said air cell groups is configured so that the bladder-shaped cells are lined up in the lengthwise direction of the air mattress, wherein the bladder-shaped cells of the air cell groups other than the air cell groups corresponding to a heel area of a person lying on the air mattress extend to an edge of said air mattress, wherein the length of the bladder-shaped cells of the air cell groups corresponding to said heel area is up to 30% less than that of the other bladder-shaped cells, and a space is left between the cells and the edge of said air mattress, wherein said air supply/release pump is disposed in said space, wherein the pressure within the bladder-shaped cells can be controlled individually for each of the air cell groups among the air cell groups linked in independent systems by said air tubes, and wherein, when the air supply/release mouths of the first connector are detached from the air supply/release mouths of the second connector, connections between said air tube in said independent system for each air cell group are released, thereby releasing control of a pressure within the bladder-shaped cells, and air within all of the bladder-shaped cells is released through said air tube.

15. An air mattress with an internal pump, comprising:

a plurality of air cell groups lined up in a lengthwise direction of the air mattress, each of which groups is made from a plurality of bladder-shaped cells;

an air supply/release pump provided with a power input cord and at least one signal cord;

an air tube linking said air cell groups and said air supply/release pump in an independent system for each air cell group of two or more air cell groups out of said air cell groups for supplying or releasing air to and from said air cell groups;

a first connector provided with air supply/release mouths connected to said air tube in said independent system for each air cell group; and a second connector provided with air supply/release mouths provided on and connected to said air supply/release pump in said independent system for each air cell group, said second connector being detachably connected to said first connector, wherein all of the bladder-shaped cells of said air cell groups are rod-shaped cells extending in a widthwise direction of the air mattress, and each of said air cell groups is configured so that the bladder-shaped cells are lined up in the lengthwise direction of the air mattress, wherein the bladder-shaped cells of the air cell groups other than the air cell groups corresponding to a heel area of a person lying on the air mattress extend to an edge of said air mattress, wherein the length of the bladder-shaped cells of the air cell groups corresponding to said heel area is up to 30% less than that of the other bladder-shaped cells, and a space is left between the cells and the edge of said air mattress, wherein said air supply/release pump is disposed in said space, wherein the pressure within the bladder-shaped cells can be controlled individually, for each of the air cell groups among the air cell groups linked in independent systems by said air tubes, wherein the first connector includes a pair of connector covers disposed such that front edges of the connector covers project in directions facing away from each other, and wherein the connector covers press upon a surface upon which the air supply/release mouths of the second connector are provided so as to attach the first connector to the second connector.

16. An air mattress with an internal pump, comprising:

a plurality of air cell groups lined up in a lengthwise direction of the air mattress, each of which groups is made from a plurality of bladder-shaped cells;

an air supply/release pump provided with a power input cord and at least one signal cord;

an air tube linking said air cell groups and said air supply/release pump in an independent system for each air cell group of two or more air cell groups out of said air cell groups for supplying or releasing air to and from said air cell groups;

a first connector provided with air supply/release mouths connected to said air tube in said independent system for each air cell group; and a second connector provided with air supply/release mouths provided on and connected to said air supply/release pump in said independent system for each air cell group, said second connector being detachably connected to said first connector, wherein all of the bladder-shaped cells of said air cell groups are rod-shaped cells extending in a widthwise direction of the air mattress, and each of said air cell groups is configured so that the bladder-shaped cells are lined up in the lengthwise direction of the air mattress, wherein the bladder-shaped cells of the air cell groups other than the air cell groups corresponding to a heel area of a person lying on the air mattress extend to an edge of said air mattress, wherein the length of the bladder-shaped cells of the air cell groups corresponding to said heel area is up to 30% less than that of the other bladder-shaped cells, and a space is left between the cells and the edge of said air mattress, wherein said air supply/release pump is disposed in said space, wherein the pressure within the bladder-shaped cells can be controlled individually for each of the air cell groups among the air cell groups linked in independent systems by said air tubes, wherein the first connector includes a pair of connector covers disposed such that front edges of the connector covers project in directions facing away from each other, wherein the connector covers press upon a surface upon which the air supply/release mouths of the second connector are provided so as to attach the first connector to the second connector, and wherein the first and second connector covers are configured to be pressed so as to detach the first connector from the second connector.

* * * * *